US005222259A

United States Patent [19]

Bristor

[11] Patent Number: 5,222,259

[45] Date of Patent: Jun. 29, 1993

[54] SHIRT WITH REMOVEABLE BASKETBALL HOOP

[76] Inventor: Kirk T. Bristor, 2299 Knob Hill, Okemos, Mich. 48864

[21] Appl. No.: 914,555

[22] Filed: Jul. 17, 1992

[51] Int. Cl.[5] ..... A41B 1/00

[52] U.S. Cl. ..... 2/115; 2/108; 2/243 R; 446/26; 446/28; 273/1.5 A; 273/1.5 R; 273/181 R; 273/317; 273/348

[58] Field of Search ..... 2/115, 108, 247, 249, 2/250, 244, 246, 243 R, 94, 69, 171, 196, 175, 185 R, 186, 195, 199; 446/26, 28, 303, 304, 398, 401, 402, 404, 407, 408, 409, 410; 273/1.5 R, 1.5 A, 181 R, 181 A, 314, 317, 318, 320, 323, 348

[56] References Cited

U.S. PATENT DOCUMENTS

| | | | |
|---|---|---|---|
| 2,939,707 | 6/1960 | Lemelson . | |
| 3,244,420 | 4/1966 | Poynter . | |
| 3,744,059 | 7/1973 | Hayes | 2/250 |
| 4,120,053 | 10/1978 | Nemirofsky | 2/115 |
| 4,274,639 | 6/1981 | Flanders . | |
| 4,354,282 | 10/1982 | Langdon . | |
| 4,466,136 | 8/1984 | Bottom et al. . | |
| 4,723,323 | 2/1988 | Wright, Jr. . | |
| 4,837,864 | 6/1989 | Thill . | |
| 4,999,848 | 3/1991 | Oney . | |
| 5,005,218 | 4/1991 | Ganz | 2/115 |
| 5,064,195 | 11/1991 | McMahan et al. | 273/1.5 |

*Primary Examiner*—Clifford D. Crowder
*Assistant Examiner*—Gloria Hale
*Attorney, Agent, or Firm*—Ian C. McLeod

[57] ABSTRACT

A basketball hoop (60) mounted on the front (18) of a shirt (10) to provide a basketball game, is described. An aperture (24) through the front of the shirt serves to mount a bracket (58) to connect the basketball hoop to a support (44) housed inside an inner pocket (38) of the shirt. To play the game, a first player (100) wears the shirt with the basketball hoop extending outward from the front of the shirt. A second player then shoots a ball (66) at the basketball hoop and attempts to score goals by moving the ball through the basketball hoop. The players then switch places with the second player wearing the shirt and the first player shooting the ball. The player to record the most goals is the winner. A second embodiment comprising a basketball rim (90) having projecting arms (88) that are received in tubes (86) mounted in an inside pocket (70) provided on the shirt (74) is also described.

21 Claims, 4 Drawing Sheets

SHIRT WITH REMOVEABLE BASKETBALL HOOP

Figure 1:
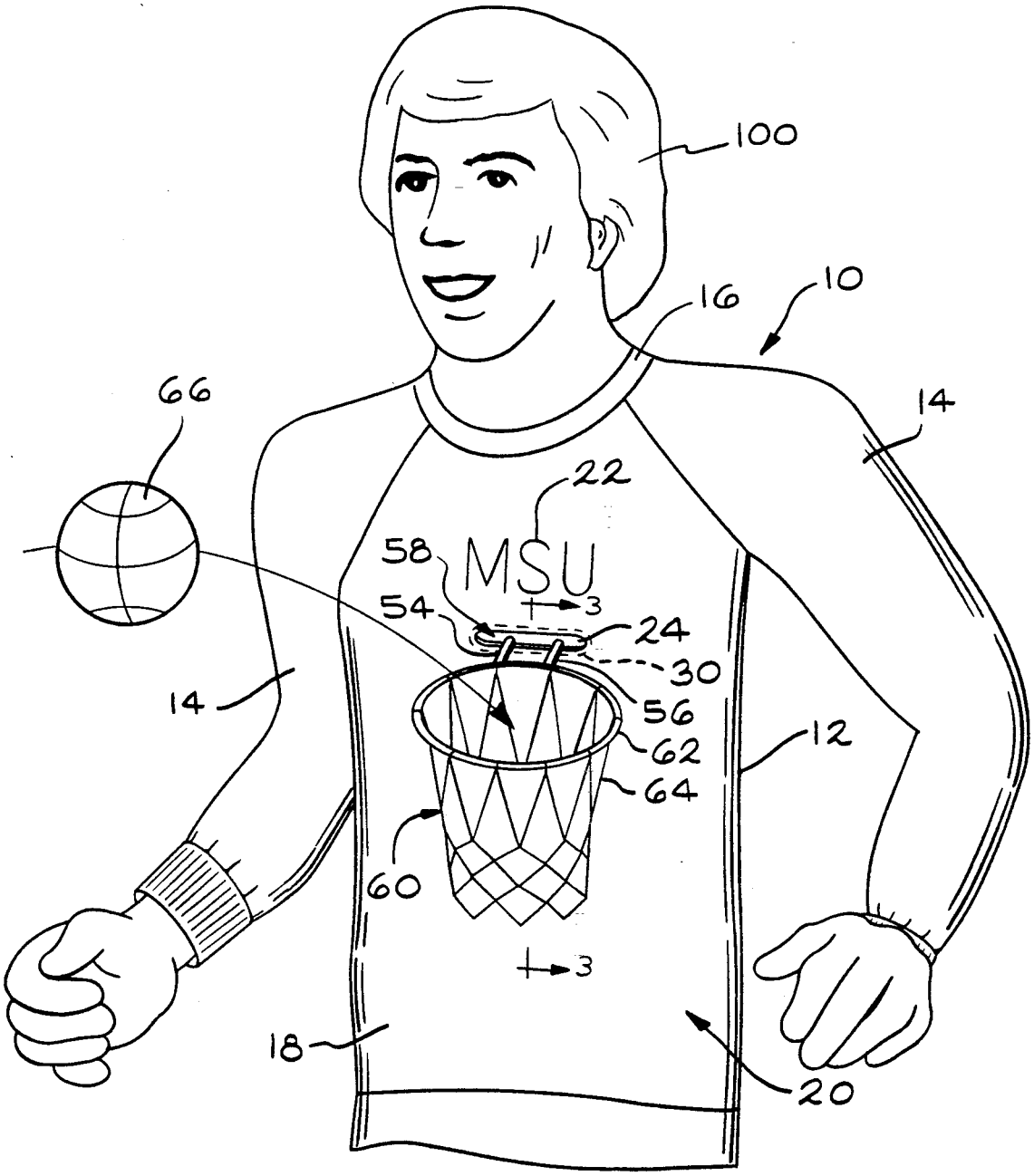

BACKGROUND OF THE INVENTION (1) Field of the Invention

The present invention generally relates to an article of clothing that provides a basketball game. In particular, the present invention relates to a shirt that is worn to support a miniature basketball basket for a basketball game. A pocket is sewn or otherwise mounted to the inside of the front portion of the shirt. An aperture through the front of the shirt provides an opening into the inside pocket. A support means is mounted in the inside pocket and a basketball receiving basket is connected to the support by a holding bracket. To play the game, the shirt is worn by a first player with the basketball basket extending upright from the front of the shirt. In this upright position, the axis of the basket is parallel to the longitudinal axis of the first player. While the first player remains relatively still, in either a standing or seated position, a second player tosses or shoots a miniature basketball at the basket. A goal is recorded when the ball moves through the basket. The players then switch places with the second player wearing the basket and the first player shooting the basketball. The basket along with the bracket and the support are preferably removeable from the shirt so that the shirt can be worn without the basket. The outer surface of the front side of the shirt can also be provided with an indicia. This can comprise a sports team logo, a school logo or any other novelty indicia.

(2) Prior Art

The prior art has described various novelty articles that provide a basketball game. Representative of these are U.S. Pat. No. 2,939,707 to Lemelson and U.S. Pat. No. 3,244,420 to Poynter. Lemelson describes a game that has a basketball basket mounted on an inflatable bag. The bag is weighted to support the basket in an upright position. The game is played by shooting the basketball through the basket. Poynter describes a miniaturized basketball basket and backboard that is mounted on the rim of a receptacle, such as a wastebasket, or the like. A player shoots a ball at the basket and points are scored when the ball falls through the basket. These devices are not intended to be worn as articles of clothing.

U.S. Pat. No. 4,274,639 to Flanders describes a basketball game and exercise apparatus that is played by two players. An inflatable ball is rotatably mounted on a shaft within a hoop. Two attachment bars extend diametrically from the hoop and connect to belts mounted on the two players. The players then rotate their hips in a circular motion. This causes the inflatable ball to rotate in the hoop. At the same time, the players take turns shooting a ball at baskets extending upright from the two attachment bars.

The prior art has also described various articles of clothing that are worn for novelty or for playing a game. These include U.S. Pat. No. 4,120,053 to Nemirofsky; U.S. Pat. No. 4,354,282 to Langdon; U.S. Pat. No. 4,466,136 to Bottom et al; U.S. Pat. No. 4,723,323 to Wright, Jr.; U.S. Pat. No. 4,837,864 to Thill and U.S. Pat. No. 4,999,848 to Oney.

Nemirofsky describes a shirt for dispensing objects. The shirt has a first pocket for receiving coins and a second pocket for dispensing gumballs, or the like.

Langdon describes a shirt having score indicia and attached score recording markers for use by a player of an active sports game. The shirt enables the player to keep an accurate tally of the score without being encumbered by a hand held or clothing pocket retained score keeping device.

Bottom et al describes a shirt having a graphical representation imprinted on the front of the shirt. A three-dimensional, self-supporting structure is connected to the shirt to complete the design.

Wright, Jr. describes a child's activity bib that is worn by an adult holding the child. The child is held facing the bib. This allows the child to interact with the activities on the bib to help stimulate the child.

Thill describes a shirt having a three-dimensional applique sewn or otherwise attached to the front of the shirt.

Oney describes a novelty shirt having a foldable flap portion mounted on the front of the shirt. Indicia are printed on the shirt and the flap portion. The flap can be lifted to reveal a message hidden under the flap.

None of these prior art devices describe an article of clothing such as a shirt that can be worn to provide a basketball game. By using a soft basketball, preferably made of foam rubber or the like, the basketball game can be played indoors without the worry of the basketball bouncing and breaking a piece of household furnishing. The game can also be played outdoors. That way, the present invention provides an easy to play basketball game that can be played by two or more players for fun and entertainment. After the players are finished playing the game, the basketball basket along with the bracket and support can be removed from the shirt, and the shirt can be worn for its customary purpose.

OBJECTS

It is therefore an object of the present invention to provide an article of clothing as a novelty garment having a basketball basket mounted to the front of the garment to provide a basketball game. Further, it is an object of the present invention to provide a shirt having a basketball basket removeably mounting to the front of the shirt to provide a basketball game that can be played by two or more players. Furthermore, it is an object of the present invention to provide a shirt having indicia printed thereon and a basketball basket removeably mounted to the shirt so that when the basket is removed from the shirt, the shirt can be worn to display the indicia. Finally, it is an object of the present invention to provide a novelty shirt having a basketball basket removeably attached to the shirt, which is inexpensive to manufacture, easy to assemble and fun to play, both indoors and outdoors. These and other objects will become increasingly apparent by reference to the drawings and to the following description.

IN THE DRAWINGS

FIG. 1 is a perspective view of a player 100 wearing a sweatshirt 10 that provides for mounting a basketball hoop 60 of the present invention.

Figure 2:
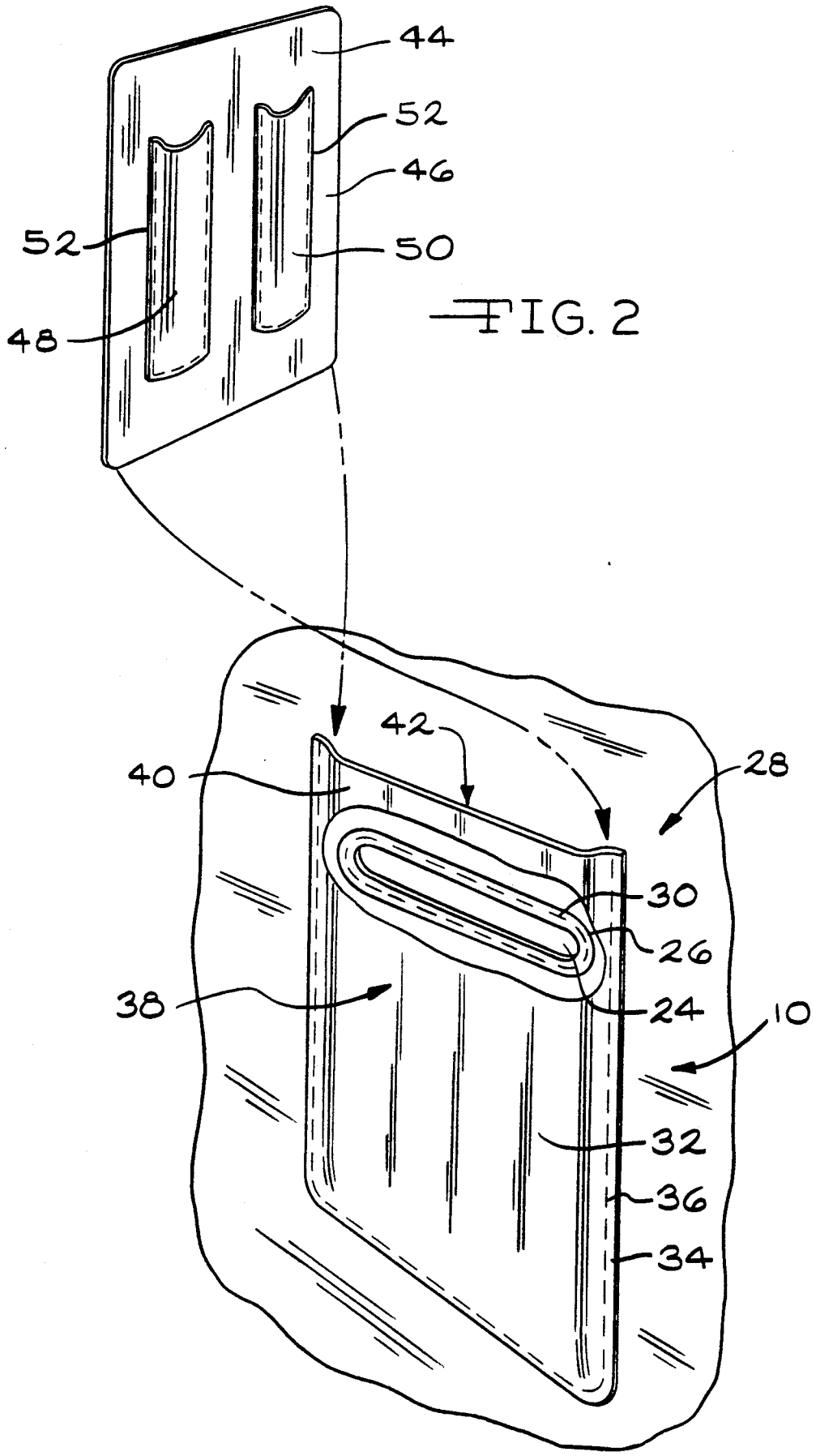

FIG. 2 is an isometric view of a pocket 38 mounted to an inner surface 28 of the sweatshirt 10 and surrounding an aperture 24 through the shirt 10 and showing a support 44 for the basketball hoop 60 that mounts inside the pocket 38.

Figure 3:
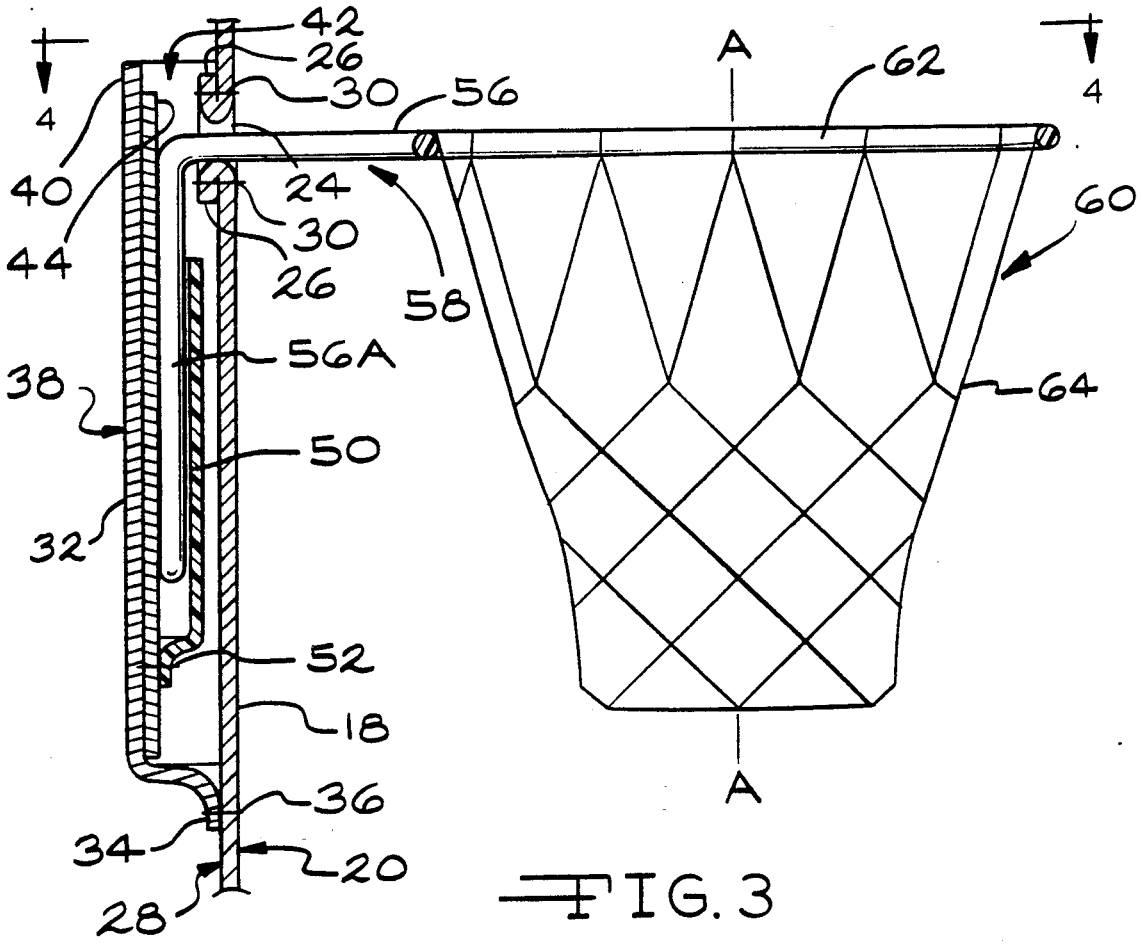

FIG. 3 is a cross-sectioned view along line 3—3 of FIG. 1 showing the basketball hoop 60 mounted to the support 44 housed inside of the pocket 38.

Figure 4:
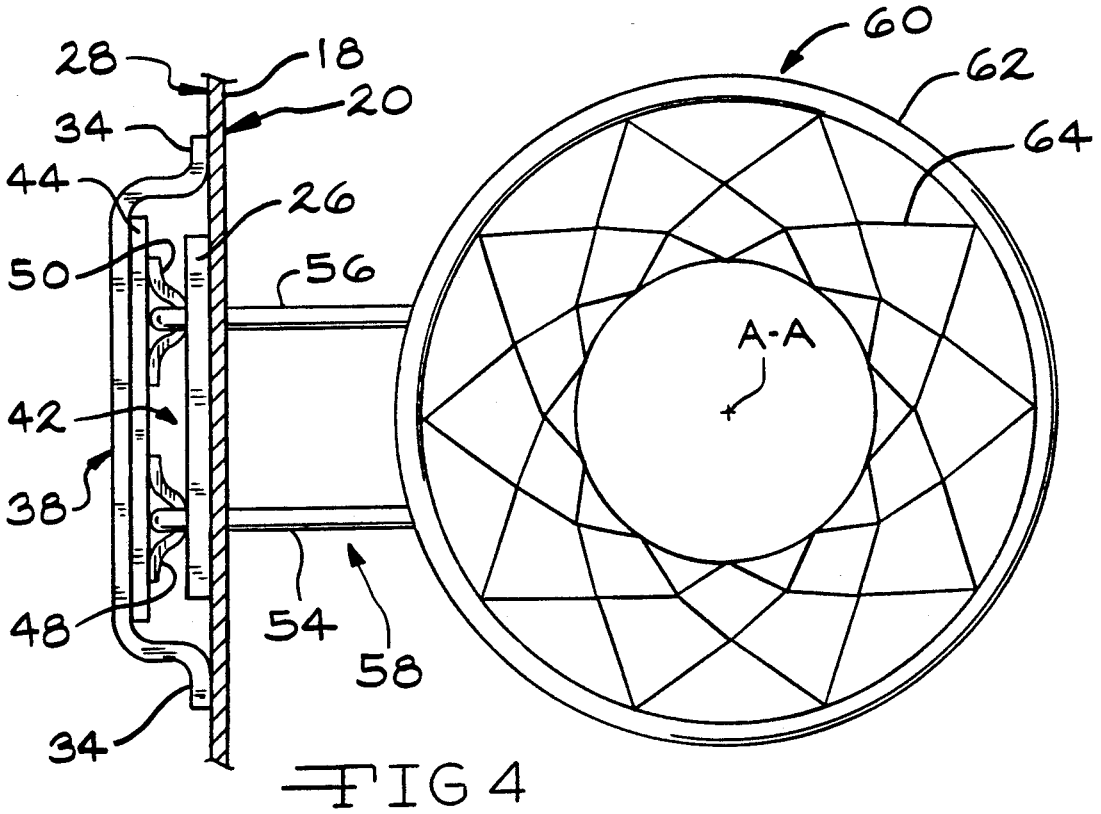

FIG. 4 is a plan cross-sectioned view along line 4—4 of FIG. 3 showing the arms 54 and 56 of bracket 58 mounted in receptacles 48 and 50 for mounting the basketball hoop 60 to the support 44 housed inside of the pocket 38.

Figure 5:
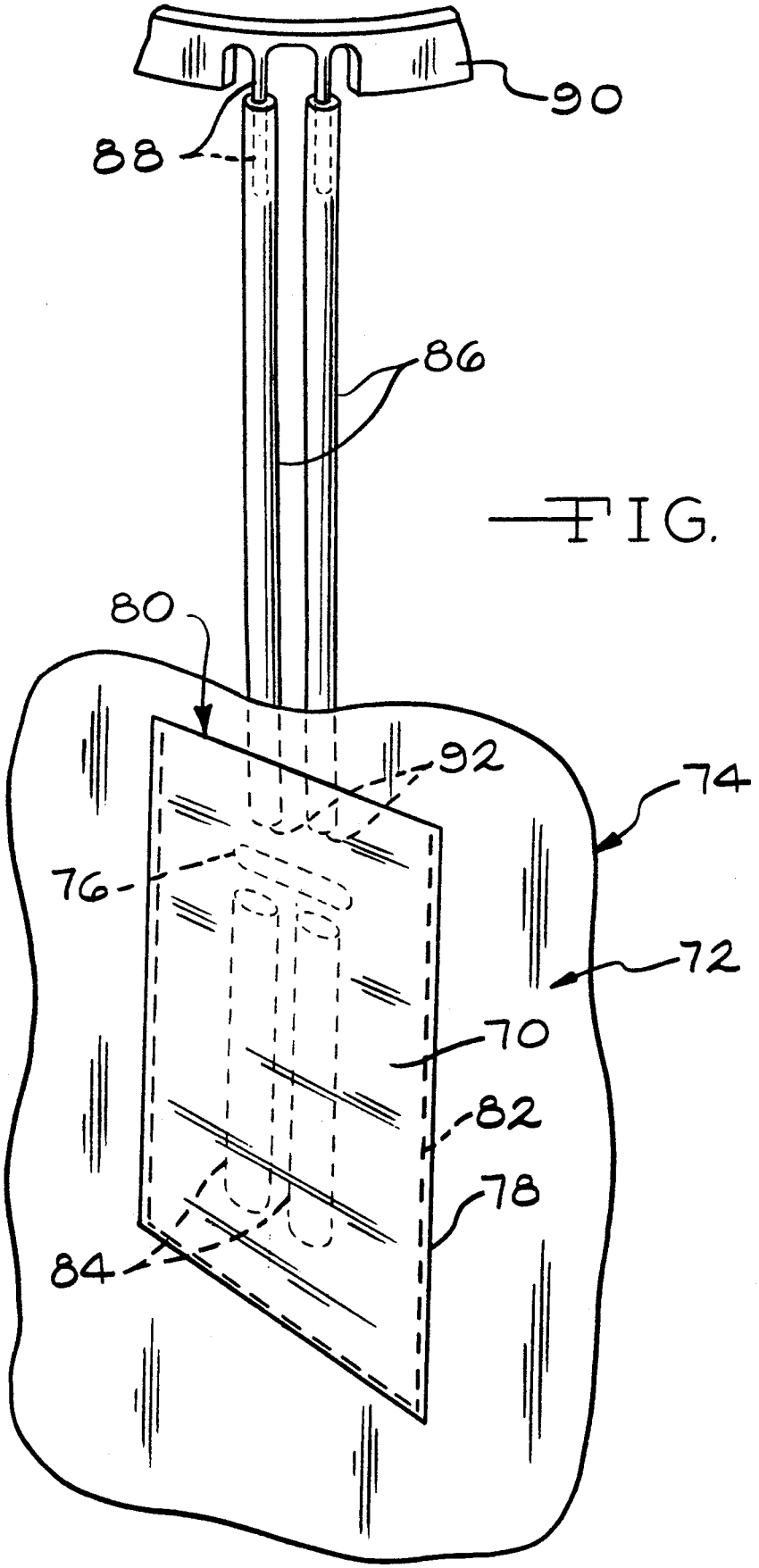

FIG. 5 is an isometric view of a second embodiment of the present invention showing a pocket 20 having receptacles 84 that receive flexible tubes 86 supporting a basketball rim 90.

GENERAL DESCRIPTION

The present invention relates a game apparatus, which comprises: an article of clothing adapted to be worn by a person, the article of clothing comprising a portion having an outer surface, an inner surface and an aperture formed through the article of clothing to communicate between the outer surface and the inner surface; a pocket means formed by a sheet of material having an outer periphery that is attached to the inner surface of the article of clothing in a generally surrounding relation to the aperture, wherein an upper portion of the sheet of material provides an opening with the inner surface of the article of clothing to provide the pocket means; a support means adapted to be carried inside the pocket means with the support means adjacent the aperture in the article of clothing; and a ball receiving goal means removeably connected by a holding means to the support means through the aperture in the article of clothing with the goal means in an operative position, forwardly of the outer surface of the article of clothing for receiving the ball.

Further, the present invention relates to a novelty garment, which comprises: a shirt comprising a front and a rear portion joined to define a waist opening, a neck opening and arm openings for covering the chest and upper back portion of a human torso, wherein the front portion of the shirt has an outer surface, an inner surface and an aperture formed through the front portion to communicate between the outer and the inner surfaces of the shirt; a pocket means formed by a sheet of material having an outer periphery that is attached to the inner surface of the front portion of the shirt in a generally surrounding relationship to the aperture, wherein an upper portion of the sheet of material provides an opening with the inner surface of the front portion of the shirt to provide the pocket means; a support means adapted to be carried inside the pocket means with the support means adjacent the aperture in the front portion of the shirt; and a ball receiving goal means removeably connected by a holding means to the front side of the support means through the aperture in the front portion of the shirt to mount the goal means in an operative position, forwardly of the outer surface of the front portion of the shirt for receiving the ball.

Still further, the present invention relates to a method of playing a game, which comprises: providing a game apparatus comprising an article of clothing adapted to be worn by a person, the article of clothing comprising a portion having an outer surface, an inner surface and an aperture formed through the article of clothing to communicate between the outer surface and the inner surface; pocket means formed by a sheet of material having an outer periphery that is attached to the inner surface of the article of clothing in a generally surrounding relation to the aperture, wherein an upper portion of the sheet of material provides an opening with the inner surface of the article of clothing to provide the pocket means; a support means adapted to be carried inside the pocket means with the support means adjacent the aperture in the article of clothing; and a ball receiving goal means removeably connected by a holding means to the support means through the aperture in the article of clothing with the goal means in an operative position, forwardly of the outer surface of the article of clothing for receiving the ball; playing the game with at least two players, wherein the first player wears the game apparatus with the second player shooting the ball at the goal means provided with the game apparatus worn by the first player to attempt to move the ball into the goal means; and scoring the number of goal means for the player shooting the ball.

Finally, the present invention relates to a method of playing a game, which comprises: providing a game apparatus comprising an article of clothing adapted to be worn by a first player, the article of clothing comprising a portion having an outer surface; and a ball receiving goal means connected by a holding means to the article of clothing with the goal means in an operative position, forwardly of the outer surface of the article of clothing for receiving the ball; playing the game with at least two players, wherein the first player wears the game apparatus with the second player shooting the ball at the goal means provided with the game apparatus worn by the first player to attempt to move the ball into the goal means; and scoring the number of goals for the player shooting the ball.

SPECIFIC DESCRIPTION

FIGS. 1 to 4 show one preferred embodiment of the shirt 10 with a removeable basketball hoop 60 of the present invention worn by a player 100. For illustrative purposes, the shirt 10 is shown in the form of a collarless long-sleeved shirt 10, such as a sweatshirt. It should be appreciated that the present invention can be connected to any type of garment. As shown in FIG. 1, sweatshirt 10 is of a conventional design and, therefore, includes a torso section 12, long sleeves 14 extending from the shoulders of the torso section 12, and a hemmed neck opening 16.

The torso section 12 of sweatshirt 10 includes a front portion 18, the outer surface 20 of which has imprinted thereon an indicia 22. The indicia 22 shown is only representative and it should be appreciated that any type and size indicia 22 can be imprinted on the sweatshirt 10 according to the scope of the present invention.

The front portion 18 of sweatshirt 10 is provided with a generally horizontal aperture 24. The aperture 24 can be formed merely by cutting a slit in the sweatshirt 10 material. However, a neater appearance is achieved if the aperture 24 is reinforced with a portion 26 of the sweatshirt 10 material folded back against an inner surface 28 of the sweatshirt 10 and secured by stitching 30. Aperture 24 thus provides for communication between the outer surface 20 and the inner surface 28 (FIG. 2) of sweatshirt 10.

As shown in FIG. 2, a sheet of flexible material 32 is secured to the inner surface 28 of the sweatshirt 10 in a generally surrounding relationship with respect to the aperture 24. Only the peripheral portion 34 of material 32 is secured to the inner surface 28, as for example, by stitching 36 to form an inner pocket 38. An upper section 40 of the outer periphery of the material 32 is left unstitched to provide an opening 42 that permits the ingress of support 44 into the pocket 38. Support 44 is preferably made of a rigid or a semi-rigid material such as plastic, fiberglass, wood, metal or any other suitable material. Support 44 is sized to pass through opening 42 and mount snugly inside pocket 38 so that the pocket 38 serves as a sheath for the support 44. This prevents the support 44 from being able to move freely inside the pocket 38.

Mounted on a front side 46 of the support 44 are a pair of generally vertical receptacles 48 and 50 that are preferably made of a semi-rigid material, such as plastic, leather or the like. The receptacles 48 and 50 are secured to the front side 46 of support 44, as for example, by stitching 52 (FIG. 3). The receptacles 48 and 50 serve to support the downwardly turned mounting portions of support arms 54 and 56 (only mounting portion 56A of arm 56 is shown in FIG. 3). The support arms 54 and 56 are rod-like members and together comprise an extending holding means as a bracket 58 that connects to and supports a goal, shown as basketball hoop 60.

The basketball hoop 60 includes a rim 62, which is circular in plan view (FIG. 4), and a net 64. When the arms 54 and 56 of bracket 58 are housed in their respective receptacles 48 and 50 of support 44 and support 44 is sheathed in pocket 38, the axis A—A of rim 62 is parallel to and spaced in front of the front portion 18 of shirt 10. The open top—open bottom net 64 extends from the periphery of rim 62 and serves to receive a ball 66 (FIG. 1) sized to pass through the rim 62 and the net 64 of basketball hoop 60.

IN USE

In use, the shirt 10 with the removeable basketball hoop 60 provides a basketball game that is able to be played by two or more players. The first player 100 wears the sweatshirt 10 having the support 44 snugly sheathed in the inner pocket 38 with the receptacles 48 and 50 positioned adjacent to the aperture 24 through the front portion 18 of the sweatshirt 10. The bracket 58 is then mounted through the aperture 24 with the support arms 54 and 56 housed in the receptacles 48 and 50 mounted on the front side 46 of support 44. In this position as shown in FIG. 1, the basketball hoop 60 extends forwardly from the first player 100.

As the first player 100 remains relatively still, a second player (not shown) shoots the ball 66 at the basketball hoop 60 as a goal, attempting to move the ball 66 through the rim 62 and the net 64 with the ball 66 exiting the goal through the lower, open end of the net 64. A goal is recorded or scored each time the ball 66 is moved through the basketball hoop 60. The ball 66 can be shot directly through the rim 62 and the net 64 or it can be first banked off the front portion 18 of the sweatshirt 10 before moving through the basketball hoop 60. In the latter case, the indicia 22 can serve as a target or a reference point for banking the ball 66 into the basketball hoop 60. As an example, the indicia 22 could look like a basketball backboard and serve as a reference for the first player 100 shooting the ball 66 at the basketball hoop 60.

After the second player has attempted a certain number of shots with the ball 66 at the basketball hoop 60, the players switch positions. The second player is now wearing the same or a different sweatshirt 10 with the basketball hoop 60 and the first player 100 shoots the ball 66 at the basketball hoop 60. The first player 100 then shoots the ball 66 at the basketball hoop 60 a corresponding number of times equal to the shot attempts tried by the first player. The player that records the greatest number of goals wins the game. Numerous game strategies are contemplated by the scope of the present invention, limited only by the imagination of the players.

After the players are finished playing the basketball game, the basketball hoop 60 can be removed from the support 44 and the support 44 can be removed from the pocket 38. The sweatshirt 10 can then be worn for its customary purpose.

It should be understood that the basketball hoop 60 of the present invention is not intended to be limited to being mounted to the front portion 18 of the sweatshirt 10. The basketball hoop 60 could be mounted to a cap or hat, to a back portion of the sweatshirt 10 or even to a pair of pants. Also, the basketball hoop 60 need not even be mounted to an article of clothing as that term is used in its customary sense. Instead, the basketball hoop 60 could be mounted to a rigid yoke that is mounted around the first player's 100 neck to cover the player's 100 upper torso. In that case, the bracket 58 could be connected directly to the yoke. There would be no need for the support 44 because the yoke will provide the rigid support for the bracket 58. In fact, the different articles of clothing and the kinds of supports, such as a yoke, that can be worn by the players to support the basketball hoop 60 are only limited by the imagination of the players.

The basketball game can also be played with each player wearing a sweatshirt 10 according to the present invention. In this case, the players will take turns having the basketball hoop 60 mounted to their sweatshirt 10 while the other player shoots the ball 66 and attempts to score goals.

FIG. 5 shows another preferred embodiment of the present invention having a pocket 70 secured to the inner surface 72 of the shirt 74 in a generally surrounding relationship with respect to an aperture 76 (shown in dashed lines), provided through the front of the shirt 74. The peripheral portion 78 of the pocket 70, except for an upper opening 80, is secured to the inner surface 72 of the shirt 74, as for example, by sticking 82. This forms the pocket 70. Sewn to the inner side of the pocket 70, facing the shirt 74 are a pair of generally vertical sheaths 84 that are preferably made of a flexible cloth material. It should be understood that the sheaths 84 need not necessarily be sewn to the pocket 70. Instead, the sheaths 84 can serve as pockets themself and be sewn directly to the inner surface 72 of the shirt 74.

The sheaths 84 are parallel and spaced apart, and serve to receive a pair of flexible support tubes 86. The tubes 86 are preferably made from a plastic material. The tubes 86 have open, upper ends forming receptacles that receive and support spaced apart cylindrical arms 88 of basketball rim 90. The arms 88 extend downwardly from the back of the basketball rim 90, which is only partially shown in the Figure. The opposite, lower end of the tubes 86 are provided with plugs or tips 92 that serve to round-off the ends. That way, if a player should fall and land on the basketball rim 90, the tips 92 will prevent the tubes 86 from puncturing the person.

In use, the basketball rim 90 comprising a portion of the basketball hoop, is sheathed on the tubes 86 by inserting the arms 88 into the receptacles formed by the open, upper end of the tubes 86. The tubes 86 are then moved through the aperture 76 on the front of the shirt 74 and inserted into the sheaths 84. The sheaths 84 serve to receive the tubes 86 so that the basketball rim 90 extends outwardly from the front of the shirt 74, in a manner similar to that shown in FIG. 1. This embodiment of the present invention can be used as a game device in a similar manner as that previously described with respect to the basketball hoop 60 and shirt 10 and shown in FIGS. 1 to 4.

It is also contemplated by the scope of the present invention that the arms 88 could be sufficiently long to mount in the sheaths 84 formed by the pocket 70 without the help of the tubes 86. In this case, the arms 88 extend downwardly a sufficient amount to mount directly in the sheaths 84 and the arms 88 themselves serve as supports for mounting the basketball rim 90 in the operative position. Also, it is preferred that the sheaths 84 be made from a firm cloth material such as canvas and the like.

It is intended that the foregoing descriptions be only illustrative of the present invention and that the present invention be limited only by the hereinafter appended claims.

I claim:

1. A game apparatus, which comprises:

(a) an article of clothing adapted to be worn by a person, the article of clothing comprising a portion having an outer surface, an inner surface and an aperture formed through the article of clothing to communicate between the outer surface and the inner surface;

(b) a pocket means formed by a sheet of material having an outer periphery that is attached to the inner surface of the article of clothing in a generally surrounding relation to the aperture, wherein an upper portion of the sheet of material provides at least one opening with the inner surface of the article of clothing to provide the pocket means;

(c) a support means adapted to be carried inside the pocket means with the support means adjacent the aperture in the article of clothing; and (d) a ball receiving goal means removeably connected by a holding means to the support means through the aperture in the article of clothing with the goal means in an operative position, forwardly of the outer surface of the article of clothing for receiving the ball.

2. The apparatus of claim 1 wherein the article of clothing has an indicia on the outer surface and adjacent to the aperture that can serve as a target for moving the ball into the goal means.

3. The apparatus of claim 1 wherein the goal means is an open top ball receiving basket.

4. The apparatus of claim 3 wherein the basket has a generally cylindrical shaped net means so that when the ball is moved through the basket, the ball moves downward through the net means to exit a lower opening in the net means.

5. The apparatus of claim 1 wherein the article of clothing is a shirt.

6. The apparatus of claim 1 wherein the holding means is comprised of arm means that project from the goal means and form into a downwardly extending portion providing the support means for the goal means, wherein the support means is received by a sheath means of the pocket means for mounting the goal means in the operative position for receiving the ball.

7. The apparatus of claim 1 wherein the holding means is comprised of arm means that project from the goal means and that mate with the support means positionable inside sheath means provided by the pocket means to support the goal means in the operative position.

8. A novelty garment, which comprises:

(a) a shirt comprising a front and a rear portion joined to define a waist opening, a neck opening and arm openings for covering the chest and upper back portion of the human torso, wherein the front portion of the shirt has an outer surface, an inner surface and an aperture formed through the front portion to communicate between the outer and the inner surfaces of the shirt;

(b) a pocket means formed by a sheet of material having an outer periphery that is attached to the inner surface of the front portion of the shirt in a generally surrounding relationship to the aperture, wherein an upper portion of the sheet of material provides at least one opening with the inner surface of the front portion of the shirt to provide the pocket means;

(c) a support means adapted to be carried inside the pocket means with the support means adjacent the aperture in the front portion of the shirt; and (d) a ball receiving goal means removeably connected by a holding means to the support means through the aperture in the front portion of the shirt to mount the goal means in an operative position, forwardly of the outer surface of the front portion of the shirt, for receiving the ball.

9. The garment of claim 8 wherein the goal means is a circular rim provided with a generally cylindrical shaped net means that depends from the rim, wherein when the ball is moved through the goal means, the ball moves in a downward direction through the rim and the net means to exit a lower opening in the net means.

10. The garment of claim 8 wherein the holding means is comprised of arm means that project from the goal means and form into a downwardly extending portion providing the support means for the goal means, wherein the support means is received by a sheath means of the pocket means for mounting the goal means in the operative position for receiving the ball.

11. The garment of claim 8 wherein the holding means is comprised of arm means that project from the goal means and that mate with the support means positionable inside sheath means provided by the pocket means to support the goal means in the operative position.

12. The garment of claim 8 wherein the shirt has indicia on the outer surface of the front portion and adjacent to the aperture that can serve as a target for moving the ball into the goal means.

13. A method of playing a game, which comprises:

(a) providing a game apparatus comprising an article of clothing adapted to be worn by a first player, the article of clothing comprising a portion having an outer surface, an inner surface and an aperture formed through the article of clothing to communicate between the outer surface and the inner surface; a pocket means formed by a sheet of material having an outer periphery that is attached to the inner surface of the article of clothing in a generally surrounding relation to the aperture, wherein an upper portion of the sheet of material provides at least one opening with the inner surface of the article of clothing to provide the pocket means; a support means adapted to be carried inside the pocket means with the support means adjacent the aperture in the article of clothing; and a ball receiving goal means connected by a holding means to the support means through the aperture in the article of clothing with the goal means in an operative position, forwardly of the outer surface of the article of clothing for receiving the ball;

(b) playing the game with at least two players, wherein the first player wears the game apparatus with the second player shooting the ball at the goal means provided with the game apparatus worn by the first player to attempt to move the ball into the goal means; and (c) scoring the number of goals for the player shooting the ball.

14. The method of claim 13 wherein the goal means is removeably connected by the holding means to the support means and wherein the second player wears a second article of clothing similar to the first article of clothing and having a second pocket means similar to the first pocket means and wherein the support means along with the ball receiving goal means connected by the holding means to the support means are transferred from the article of clothing worn by the first player to the second player's article of clothing with the first player then shooting the ball at the game apparatus worn by the second player.

15. The method of claim 13 wherein the article of clothing has an indicia on the outer surface and adjacent to the aperture that serves as a target for the second player shooting the ball at the goal means.

16. The method of claim 13 wherein the goal means is an open top ball receiving basket.

17. The method of claim 15 wherein a generally cylindrical shaped net means depends from the basket so that when the player shooting the ball moves the ball through the basket, the ball moves downwardly through the net means to exit a lower opening in the net means.

18. The method of claim 13 wherein the holding means is comprised of arm means that project from the goal means and form into a downwardly extending portion providing the support means for the goal means, wherein the support means is received by a sheath means of the pocket means for mounting the goal means in the operative position for receiving the ball shot by the second player shooting the ball at the goal means provided by the first player wearing the game apparatus.

19. The method of claim 13 wherein the goal means is removeably connected by the holding means to the support means carried inside the pocket means for removing the goal means from the support means.

20. A method of playing a game, which comprises:

(a) providing a game apparatus comprising an article of clothing adapted to be worn by a first player and having an outer surface; and a single ball receiving goal means connected by a holding means to the article of clothing with the goal means in an operative position, forwardly of the outer surface of the article of clothing, and supported only by the first player for receiving the ball;

(b) playing the game with at least two players, wherein only the first player wears the game apparatus and with the second player shooting the ball at the goal means provided by the game apparatus worn by the first player to attempt to move the ball into the goal means; and (c) scoring the number of goals for the player shooting the ball.

21. The method of claim 20 wherein the goal means is removeably connected by the holding means to the article of clothing and wherein the second player wears a second article of clothing similar to the first article of clothing and further comprising the steps of transferring the ball receiving goal means connected by the holding means to the first article of clothing to the second player's article of clothing with the first player then shooting the ball at the game apparatus worn by the second player.

* * * * *